United States Patent [19]

Karlsson et al.

[11] Patent Number: 4,953,629

[45] Date of Patent: Sep. 4, 1990

[54] PACK OF HEAT TRANSFER PLATES

[75] Inventors: Kurt Karlsson, Tyresö ; Birger Pettersson, Värmdö, both of Sweden

[73] Assignee: Svenska Rotor Maskiner AB, Stockholm, Sweden

[21] Appl. No.: 382,650

[22] PCT Filed: Feb. 25, 1988

[86] PCT No.: PCT/SE88/00083

§ 371 Date: Aug. 4, 1989

§ 102(e) Date: Aug. 4, 1989

[87] PCT Pub. No.: WO88/06709

PCT Pub. Date: Sep. 7, 1988

[30] Foreign Application Priority Data

Feb. 27, 1987 [SE] Sweden ..... 8700856

[51] Int. Cl.[5] ..... F28D 19/04; F28D 17/02

[52] U.S. Cl. ..... 165/10; 165/5; 165/8

[58] Field of Search ..... 165/10, 8, 5

[56] References Cited

U.S. PATENT DOCUMENTS 3,465,815 9/1969 Wheeler ..... 165/10
4,209,060 6/1980 Wibing ..... 165/10
4,396,058 8/1983 Kurschner et al. ..... 165/10
4,449,573 5/1984 Pettersson et al. ..... 165/10

FOREIGN PATENT DOCUMENTS 2183811 6/1987 United Kingdom ..... 165/10

*Primary Examiner*—Albert W. Davis, Jr.
*Attorney, Agent, or Firm*—Frishauf, Holtz, Goodman & Woodward

[57] ABSTRACT

A pack of heat transfer plates (2,3) are intended for heat exchangers, preferably for rotary regenerative air preheaters. The plates have mutually parallel S-shaped double ridges (21,22;31,32) and the plates are arranged in the pack (1) so that the double ridges of one plate intersect the double ridges of an adjacent plate and extend symmetrically and obliquely in mutually opposite directions relative to the main flow directions (6) of the heat exchanging media. The throttling effect normally manifest at the double-ridge intersections (24) is avoided by orienting the plates (2,3) so that each pair of double ridges which converge onto an intersection (24) presents a part (21) of the double ridge of the one plate (2) which projects into an intermediate channel, and also a part (32) of the double ridge of the other plate (3) which projects from the intermediate channel.

2 Claims, 1 Drawing Sheet

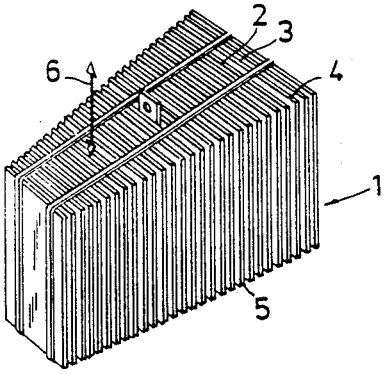
Fig. 1
Fig. 2
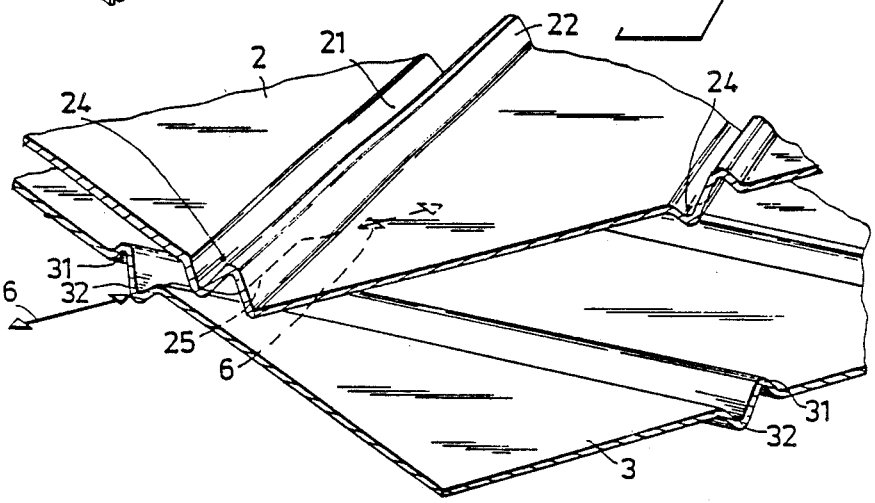
Fig. 3
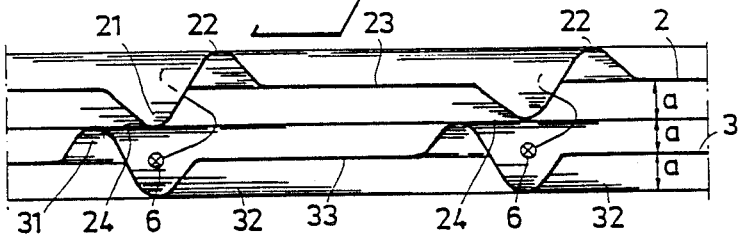
Fig. 4
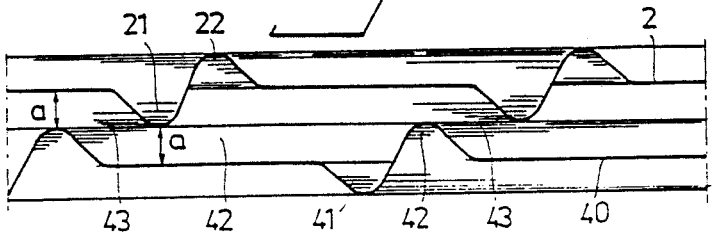

PACK OF HEAT TRANSFER PLATES

BACKGROUND OF THE INVENTION

The present invention relates to a pack of heat transfer plates for use in heat exchangers, preferably in rotary regenerative air preheaters.

Heat transfer plates which each have corrugations formed by S-shaped double ridges on respective plates and intermediate flat or slightly undulated plate portions are known, for instance, from British Patent Specification Nos. 1,335,205 and 1,252,319, respectively. These known plates have been found to possess optimum values with regard to heat transfer characteristics and low pressure drop conditions. When stacked in wedge-shaped packs in regenerative air preheaters in particular, the advantages afforded by those known heat transfer plates are utilized fully in a particularly beneficial manner, since it has been found that such packs are less liable to become blocked by so-called soot and other particulate solids present in flue gases than are other types of heat transfer plates used for a similar purpose.

The known packs of plates are produced in accordance with three mutually different methods. According to the first of these methods, a strip of sheet metal is first rolled between two profiled rolls and therewith given the intended profiled shape, whereafter the thus profiled metal strip is cut progressively into a large number of pieces, the size of which represents, for instance, the smallest or narrowest dimension of a wedge-shaped pack of plates, whereafter the profiled metal strip is again cut into an equal number of plates, the size of which represents the next smallest dimension of the pack, and so on until plates having the largest desired dimension have been cut from said strip of profiled sheet metal. In this way there is produced a store of plates having the various requisite dimensions from which the plates required can be collected in sequence, with successively increasing or decreasing dimensions and the plates stacked upon each other with the double ridges of mutually adjacent plates intersecting one another, i.e. subsequent to turning each alternate plate through 90°, to form a wedge-shaped pack of plates. The flow channels defined by mutually contiguous plates will then have the pattern illustrated in the above mentioned British patent specifications.

According to the second of these three known methods, respective strips of sheet metal are rolled simultaneously in separate roll stands which are mutually so arranged that when the sheet metal strips are fed out from respective roll pairs in superposed relationship, the double ridges of respective strips will intersect one another in the manner illustrated, for example, in British Patent Specification No. 1,401,621. This method includes cutting both of the sheet metal strips simultaneously into smaller pieces while successively changing the plate dimensions after each cutting operation, so that the pieces cut from the strips can be stacked immediately in the form of a wedge-shaped body, whereafter the procedure is repeated for the next pack of plates in line.

The third of the aforesaid three known methods can be said to comprise a combination of the first and the second methods. In the case of the third method, there is used only one roll stand, and subsequent to dividing the metal strip into smaller pieces, or plates, the plates are formed into packs, although it is necessary in this case to turn each alternate plate subsequent to cutting said plate from the strip, so that the double ridges on mutually adjacent or contiguous plates will intersect one another.

The sole drawback exhibited by these known plates is that some difficulty is experienced in effectively blowing away so-called soot and products of corrosion, since the soot blowing jets are disintegrated in the flow channels between the plates by the obliquely extending double ridges. As a result the channels defined by mutually adjacent or contiguous plates may become partially blocked sporadically, which may necessitate shutting down the heat exchange system in order to clean the air preheater.

For this reason this type of heat transfer plate has not been accepted in some countries, despite being available for seventeen years, while in other countries the plate has been accepted on the merits of its high heat transfer performance and has been used in conjunction with auxiliary solutions for improving the ejection of so-called soot and other solids by blowing. One such solution has involved dividing the heat transfer plates into at least two parts in the direction of medium flow with an empty space between said two parts, so that so-called soot and other solids can be blown towards the empty space, from both ends of the plates. This solution is not an ideal solution, however, either from the aspect of blowing the plates clean of soot or from the aspect of space.

The object of the present invention is to improve the flow pattern in this type of plate pack, such as to prevent blocking of the channels between adjacent plates, either partially or completely, in a more effective manner.

SUMMARY OF THE INVENTION

This object has been achieved in accordance with the invention by mutually orientating the plates so that each pair of double ridges converging towards a point of intersection presents a part of the double ridges of one plate which protrudes into an intermediate channel, and a part of the double ridges of the other plate which protrudes away from said intermediate channel.

It has been observed that in those instances when blocking has occurred, it has commenced at a location at which a pair of double ridges which converge towards an intersection point both present a part of the double ridges which projects into an intermediate channel. This means that a plate has been turned in a disadvantageous manner, despite the fact that the double ridges of the plate intersect the double ridges of mutually adjacent plates, and that consequently several intersection points on this plate have a tendency to initiate blockages. The reason why such points of intersection initiate blockages is because they act in the manner of funnel-shaped constrictions in which particles of so-called soot, smuts and other solids, and often sticky particles, collect and impede the throughflow of heat exchanging media. The jets used to blow away so-called soot and other solids are also slowed down by the intersections.

In the case of one embodiment according to the invention, all intersections are mutually the same, the essential inventive feature being that at each intersection one double ridge will always have a part which projects away from the channel and Which Will permit the flow of medium to pass the intersection. This arrangement will also enable the jets used to blow away soot etc. to pass through the intersection without necessarily being retarded.

In order to reduce the resistance to flow to the greatest possible extent, and therewith also the tendency for blockages to occur, the S-shaped double ridges of each plate according to one preferred embodiment are separated in a known manner by a flat portion whose width is considerably greater than the width between the ridges of each double ridge.

BRIEF DESCRIPTION OF THE DRAWINGS

FIG. 1 is a perspective view of a wedge-shaped pack of heat transfer plates;

FIG. 2 is a perspective view in partial section which illustrates the medium flow at the ridge intersection point of two superimposed plates constructed in accordance with the invention;

FIG. 3 is a simplified view of the FIG. 2 illustration taken in the direction of medium flow; and FIG. 4 is a view similar to FIG. 3 but illustrating the medium flow in the case of two plates that are not constructed in accordance with the invention.

DETAILED DESCRIPTION

FIG. 1 illustrates a wedge-shaped pack 1 of heat transfer plates 2, 3 which are of the kind illustrated in FIGS. 2 and 3 and which are intended for use in a rotary regenerative air preheater. A preheater of this kind will contain a large number of plate packs 1 which form an annular body in the preheater and which present channels for the heat transfer media, these channels extending between two mutually opposite end surfaces 4, 5 of the respective plate packs 1. The main direction of media flow is indicated by the double arrow 6.

Each plate 2, 3 is provided with corrugations in the form of S-shaped double ridges 21, 22 and 31, 32, with a distance 2*a* between the apices of respective ridges of each double ridge. The distance between the flat plate portions 23, 33 is thus 2*a*. As will be seen from FIGS. 2, 3, the distance between the superimposed plates alternates between 2*a* and 4*a* at the double-ridge intersection points 24, the media flow path at these intersections being indicated by an arrow 25. This means that particles of soot, smuts and other solids accompanying the heat transfer media can readily pass the intersections 24. The conditions are the same in the case of medium flow from the opposite direction and in adjacent channels (not shown).

For the sake of comparison a study can be made of the events which take place in the case of plates which although positioned so that their double ridges mutually intersect are not oriented in relation to one another in accordance with claim 1. Such a case is illustrated in FIG. 4, in which one plate 40 having double ridges 41, 42 has a different orientation to the corresponding plate of the FIG. 3 embodiment. In the case of the FIG. 4 embodiment the portions 21 and 42 of respective double ridges 21, 22 and 41, 42 face one another at the intersections 43, such that the distance between the plates is merely a, resulting in a constricted flow passage at the location of said intersections. The whole of the channel between the plates 2 and 40 has a throttling effect on the medium flow, particularly when compared with the medium flow in the two channels (not shown) immediately adjacent the former channel. These two adjacent channels have a larger effective area than the former channel and thus conduct a relatively large flow of medium, if also these plates should be wrongly oriented. The constrictions occurring at the intersections 43 are liable to cause particles of soot, smuts and other solids entrained with the medium flow to fasten immediately upstream of the intersections 42 and thereafter in the funnel-shaped spaces upstream of said intersections, as seen in the flow direction. Thus, of all the heat transfer plates included in, e.g., the preheater, it suffices that solely one plate is wrongly oriented to initiate clogging or blocking of the flow channels, this initial clogging of the channels normally spreading rapidly to other flow channels. In order to eliminate all risk of the plates being wrongly oriented, it is necessary to roll the metal strip and to cut the profiled metal strips into plate form and then to pack the resultant plates automatically in a given sequence, for example with the aid of two roll stands of the kind illustrated in the British Patent Specification No. 1,559,084 with direct feed to a strip cutting or shearing device and from there immediately to a facility for packing the resultant heat transfer plates into ready-for-use plate packs, in accordance with British Patent Specification No. 1,401,621. The use of two roll stands obviates the need to turn each alternate plate prior to gathering the plates into packs in accordance with hitherto standard procedure, this standard procedure invariably resulting in the plates of at least a multiple of plate packs in each air preheater being correctly and incorrectly oriented in an uncontrollable manner. Thus, both of the British Patent Specifications mentioned in the introduction illustrate heat transfer plates which are so oriented as to oppose the disclosures of the present claim 1. When applying the method in which one roll stand is used and in which each alternate plate is turned through a given number of degrees, it must be ensured that respective plates are turned always about an axis at right angles to the main direction of the ultimate channels, i.e. parallel with the directional line along which the profiled strip is fed through the strip cutting device. If this proviso is not fulfilled, the plates will be wrongly oriented. It must also be ensured that continuity is maintained subsequent to a breakdown. All of these pitfalls are avoided when using double roll stands.

We claim:

1. In a pack of heat transfer plates for heat exchangers, comprising:

a plurality of mutually identical profiled plates (2,3) which are arranged in mutually contiguous relationship and which form channels for passage of a heat exchanging media, said channels extending between two mutually opposing end surfaces (4,5) of the pack (1), and in which each plate in the pack (1) has provided thereon corrugations in the form of mutually parallel S-shaped double ridges (21,22;31,32) which project symmetrically and obliquely from both opposite sides of each said plate;

said plates (2,3) being oriented such that the double ridges of one plate intersect the double ridges of an adjacent plate, and said adjacent plates being in contact with one another solely at points of intersection (24) of said intersecting double ridges and;

said double ridges of respective plates extending symmetrically and obliquely in mutually opposite directions relative to main flow directions (6) of the heat exchanging media flowing in the channels formed between adjacent plates;

the improvement wherein:

said plates (2,3) are mutually oriented such that each pair of double ridges which, as viewed in the main directions (6) of the flows of heat exchanging media, converge towards a point of intersection (24) presents a part (21) of the double ridge of one plate (2) which projects into an intermediate channel, and also a part (32) of the double ridge of the other plate (3) which projects away from said intermediate channel, so as to provide substantially equal flow of said heat exchanging media between all plates of said pack independent of the flow direction of the heat exchanging media.

2. The pack of heat transfer plates of claim 1, wherein said S-shaped double ridges of each plate are separated by a flat plate portion (23) which has a width that greatly exceeds the width of each double ridge (21,22;31,32).

* * * * *